United States Patent [19]

Bassett

[11] 4,432,219

[45] Feb. 21, 1984

[54] KEY CONCEALMENT ATTACHMENT

[76] Inventor: Robert F. Bassett, 126 Grandview Ter., Batavia, N.Y. 14020

[21] Appl. No.: 298,089

[22] Filed: Aug. 31, 1981

[51] Int. Cl.[3] ..... A47G 29/10

[52] U.S. Cl. ..... 70/456 R

[58] Field of Search ..... 70/456 R, 456 B, 457, 70/458; 292/251.5; D3/61, 62; 150/40

[56] References Cited

U.S. PATENT DOCUMENTS

| | | | |
|---|---|---|---|
| D. 161,059 | 11/1950 | Shevin | D3/61 |
| 1,641,110 | 8/1927 | Wolfing | 70/456 R |
| 4,033,013 | 7/1977 | Peterson | 292/251.5 |

FOREIGN PATENT DOCUMENTS

| | | | |
|---|---|---|---|
| 2226385 | 12/1973 | Fed. Rep. of Germany | 70/456 R |

*Primary Examiner*—Robert L. Wolfe

*Attorney, Agent, or Firm*—Jack C. Munro

[57] ABSTRACT

An attachment to a key to facilitate concealment of the key, which takes the form of a bifurcated housing within which is embedded magnetic material. The bifurcated housing includes a fastener, which in operation passes through an opening formed within the large handle section of the key. The exterior sidewalls of the bifurcated housing deflect to become recessed during operation of the fastener to thereby form recessed areas to facilitate grasping and holding of the attachment thereby facilitating operation of the key.

1 Claim, 4 Drawing Figures

KEY CONCEALMENT ATTACHMENT

BACKGROUND OF THE INVENTION

This invention relates to a device for concealing a key, and more particularly to an attachment which is readily engageable with any conventional key and which can then be located in a place of concealment.

The structure of this invention can be used in any environment. However, the primary environment of usage would be a vehicle, such as an automobile.

It is not at all uncommon for individuals to lock themselves out of their vehicle. If such does occur, it would be advisable to have available an extra key hidden but located on the exterior structure of the automobile. A common way that such an extra key can be provided is through the use of a magnetic device which can then be located in a concealed area of the vehicle which would be known only to the vehicle operator.

In the past, there have been various types of magnetic key holders. Such key holders have been generally complicated in structure which substantially increases manufacturing cost, as well as overall selling price. Also, the magnetic attachment has to be extremely secure or else the key could become dislodged during rough-road conditions.

SUMMARY OF THE INVENTION

The structure of this invention is directed to a simple attachment which can be readily attached to any conventional key which then makes the key easily and quickly locatable in a concealed area. The attachment is non-complex and can be manufactured and sold inexpensively.

An embodiment of the attachment of invention takes the form of a bifurcated housing which is constructed of a pair of disc shaped legs which are connected together at an apex. An enlarged slot is formed between the legs. The attachment material is flexible and is magnetized. A male fastener is mounted within one of the legs and a female fastener mounted within the other of the legs. The male and female fasteners are to connect together within the slot. The connected together fasteners are to extend through an opening provided within the handle section of a conventional key. The housing of molded magnetic deflectable material permits the connecting together of the fastener.

DETAILED DESCRIPTION OF THE SHOWN EMBODIMENT

Figure 1:
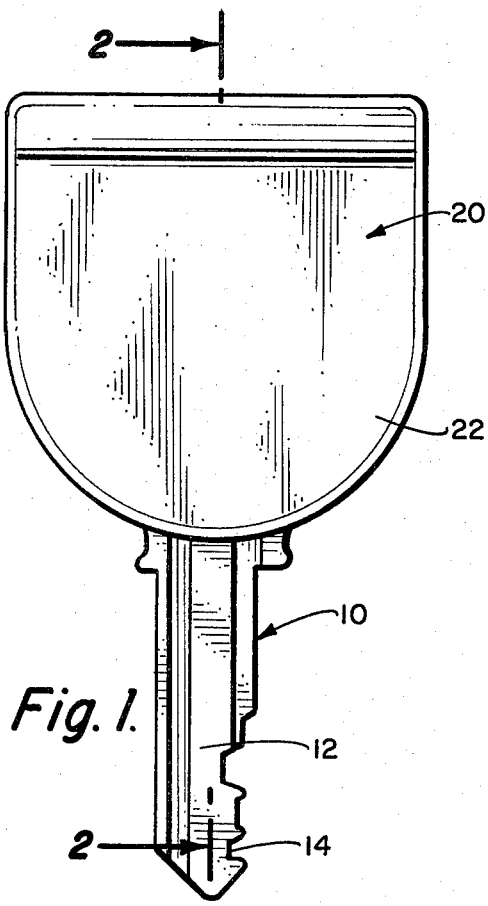
FIG. 1 is a side, elevational view of the attachment of this invention showing the attachment being mounted on a conventional key.
Figure 2:
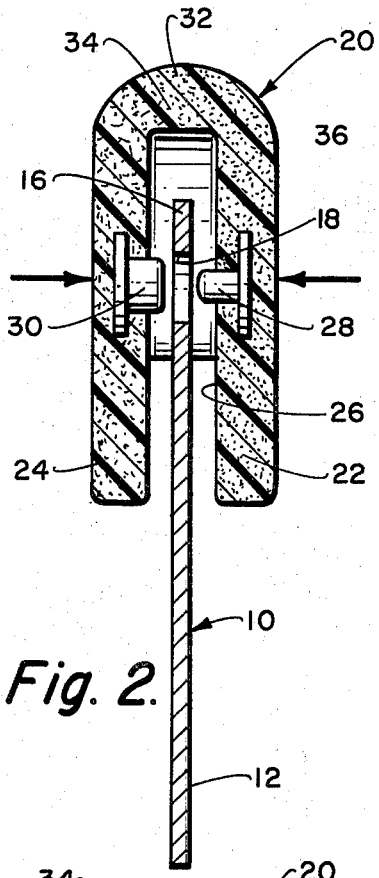
FIG. 2 is a cross-sectional view taken along line 2—2 of FIG. 1.

Referring particularly to the drawing, there is shown in FIG. 1 a conventional key 10 which includes an elongated shank 12 which has irregular shaped cut-outs 14. The shank 12 is integrally attached to an enlarged handle section 16. Within the enlarged handle section 16 is an opening 18. The foregoing describes a conventional key which is to be employed to operate a conventional lock.

In this embodiment, the attachment 20 of this invention takes the form of a housing formed by a pair of disc-shaped legs 22 and 24 which are connected together by an apex section 32. Separating the legs 22 and 24 is an enlarged slot 26. It is to be noted that the molded material of construction for the housing of the attachment 20 will normally comprise a somewhat deflectable material, such as a plastic. The plastic is to be embedded with metallic particles 34. After fabrication, the resulting structure is magnetized.

Secured within the leg 22 and extending within the slot 26 is a male member 28 of a conventional fastener assembly. A female member 30 of the fastener assembly is secured within the leg 24. The members 28 and 30 are capable of being connected together, as is shown in FIG. 3 of the drawing.

To connect the attachment 22 to the key 10, the operator locates the key 10 so that the handle section 16 is located within the groove 26. The key 10 is positioned so that the opening 18 is located between the fastening members 28 and 30. The sides of the slot 26 is sufficiently large enough to accommodate any size of key handle section 16. The operator then forces the male fastening member 28 into the female fastening member 30. This binds together the legs 22 and 24 against handle section 16 thereby fixedly securing the attachment 20 to the key 10. The key 10 is then to be readily located in a concealed environment by locating such and the key 10 will be maintained in that environment due to the magnetized attachment 20 as long as the area of concealment is constructed of a metallic paramagnetic material.

The fastening members 28 and 30 are constructed to be easily closable but once closed are difficult to reopen. However, the applying of sufficient force will separate member 28 from member 30.

Figure 3:
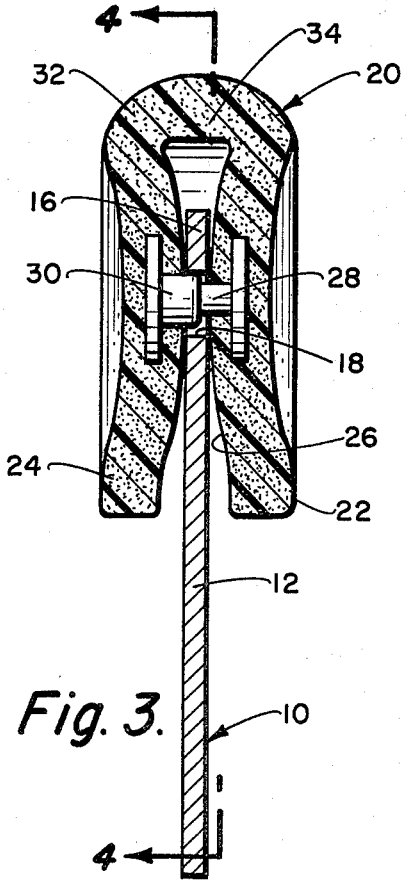
FIG. 3 is a cross-sectional view similar to FIG. 2 but showing the fastener in the connected position.
Figure 4:
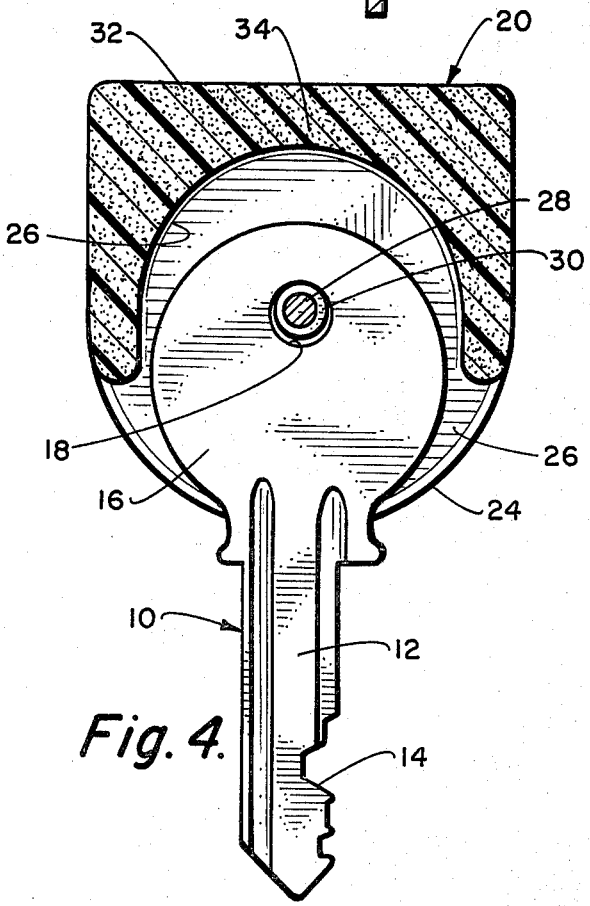
FIG. 4 is a side view, partly in cross-section, taken along line 4—4 of FIG. 3.

When the fasteners 28 and 30 are connected together as shown in FIG. 3, it can be seen that the exterior surface of each of the legs 22 and 24 becomes recessed. These recesses facilitates grasping and holding of the attachment 20 to thereby facilitate using of the key 10.

As a modification, the fasteners 28 and 30 could be eliminated with almost touching protuberances utilized instead. The handle section 16 is to be forced between the protuberances which then close together in opening 18.

What is claimed is:

1. In combination with a key, said key having a shank section attached to an enlarged handle section, an opening formed within said enlarged handle section, an attachment connectable to said key to facilitate concealment of said key, said attachment comprising:

a bifurcated housing having a pair of spaced apart legs forming a slot therebetween, an apex section connecting together said legs;

a mass of magnetic particles embedded in said apex section of said bifurcated housing to facilitate mounting of said housing to an exterior metallic structure; and fastening means connected between said legs, said fastening means to pass though said opening to tightly bind together said legs and said handle section of said key, said fastening means to be movable between an open position and a closed position, said fastening means being easily moved into said closed position but difficult to be moved to said open position, said fastening means comprising a male member and a female member, said closed position being when said male member is imbedded within said female member tightly securing said male member to said female member, movement of said fastening means to said closed position causes the exterior wall of each of said legs to be deflected inwardly to form recesses to thereby form thumb and finger cavities to facilitate operation of said key.

* * * * *